United States Patent [19]

Horowitz

[11] Patent Number: 4,936,194

[45] Date of Patent: Jun. 26, 1990

[54] BOAT STAKE

[76] Inventor: Andrew D. Horowitz, 11021 Belmar Ave., Northridge, Calif. 91326

[21] Appl. No.: 318,695

[22] Filed: Mar. 3, 1989

[51] Int. Cl.[5] ..... E02D 5/74; D05B 57/14

[52] U.S. Cl. ..... 52/155; 114/230; 52/721

[58] Field of Search ..... 119/120–122; 135/118; 52/721, 155, 146; 29/DIG. 23; 72/703; 114/230; 16/110 R, 111 R; 248/156

[56] References Cited

U.S. PATENT DOCUMENTS

| | | | |
|---|---|---|---|
| 1,617,557 | 2/1927 | Weatherhead | 16/110 R |
| 1,832,811 | 11/1931 | Jowett | 16/111 R |
| 2,365,197 | 12/1944 | Kay | 72/703 |
| 3,063,402 | 11/1962 | Vallquist | 114/230 |

FOREIGN PATENT DOCUMENTS

| | | | |
|---|---|---|---|
| 82557 | 11/1952 | Norway | 119/122 |
| 806242 | 12/1958 | United Kingdom | 52/721 |

*Primary Examiner*—James L. Ridgill, Jr.
*Attorney, Agent, or Firm*—Poms, Smith, Lande & Rose

[57] ABSTRACT

A stake for mooring a boat comprising an elongated ground piercing stake having a handle at the upper end and a plurality of spaced holes between the lower ground piercing end and the handle. An apertured plate is pivotally mounted to the stake by an elongated securement member mounted in one of the holes and an elongated flexible rope is secured to the aperture in the plate. The rope terminates in a releasable hook. The hole in the stake is selected depending on the depth of ground penetration desired. The hook is connected to the bow of the boat to be secured and the stake is pulled to a selected mooring location and the stake is inserted into the ground by holding the handle and pushing down with one's foot and the elongated flange securement member until the latter abuts against the ground. In this manner, the tethered boat is secured in a desired mooring location.

7 Claims, 1 Drawing Sheet

10
11
12
13
14
15
16
17
18
19
20
21
22
23
24
25
26
27
28
29
30
32
33
35
36
37
38
39
40
41
42
43
44
45
46
47
IV

BOAT STAKE

BACKGROUND OF THE INVENTION

1. Field of the Invention

The invention relates to boat stakes; and, more particularly, to a stake for mooring a boat in a desired location.

2. Description of the Prior Art

Various types of boat mooring devices are known in the art. As a general rule, such devices comprise some sort of anchor or the like which is tethered by a rope to the boat. The anchor is embedded in the sand or the like on shore and the boat is thus moored at that location. Such devices usually have as the anchoring portion a complicated and expensive anchor and such anchors merely bite into the sand and are easily dislodged. Such anchors also have only one way in which they dig into the sand. There is thus a need for a boat stake having a plurality of ground depth penetration levels with firm securement at such selected level and a handle at the upper end for assisting in such penetration.

SUMMARY OF THE INVENTION

It is an object of this invention to provide a boat stake which can be anchored in the ground to a plurality of preselected depths.

It is a further object of this invention to have such a boat stake with a handle for assisting in such ground penetration at its upper end.

It is still further an object of this invention to provide such boat stake where the handle is reversible for right or left hand use.

It is another object of this invention to provide such a boat stake with a pivotal aperture flange having an elongated rope connected thereto terminating in a releasable boat hook.

These and other objects are preferably accomplished by providing an elongated ground piercing stake having a handle at the upper end and a plurality of spaced holes between the lower ground piercing end and the handle. An apertured plate is pivotally mounted to the stake by an elongated securement member mounted in one of the holes and an elongated flexible rope is secured to the aperture in the plate. The rope terminates in a releasable hook. The hole in the stake is selected depending on the depth of ground penetration desired. The handle may be oriented for right or left hand use. The hook is connected to the bow of the boat to be secured and the stake is pulled to a selected mooring location and the stake is inserted into the ground by holding the handle and pushing down with one's foot and the elongated flange securement member until the latter abuts against the ground. In this manner, the tethered boat is secured in a desired mooring location.

DESCRIPTION OF THE PREFERRED EMBODIMENT

Figures 1, 2, 3, 4:
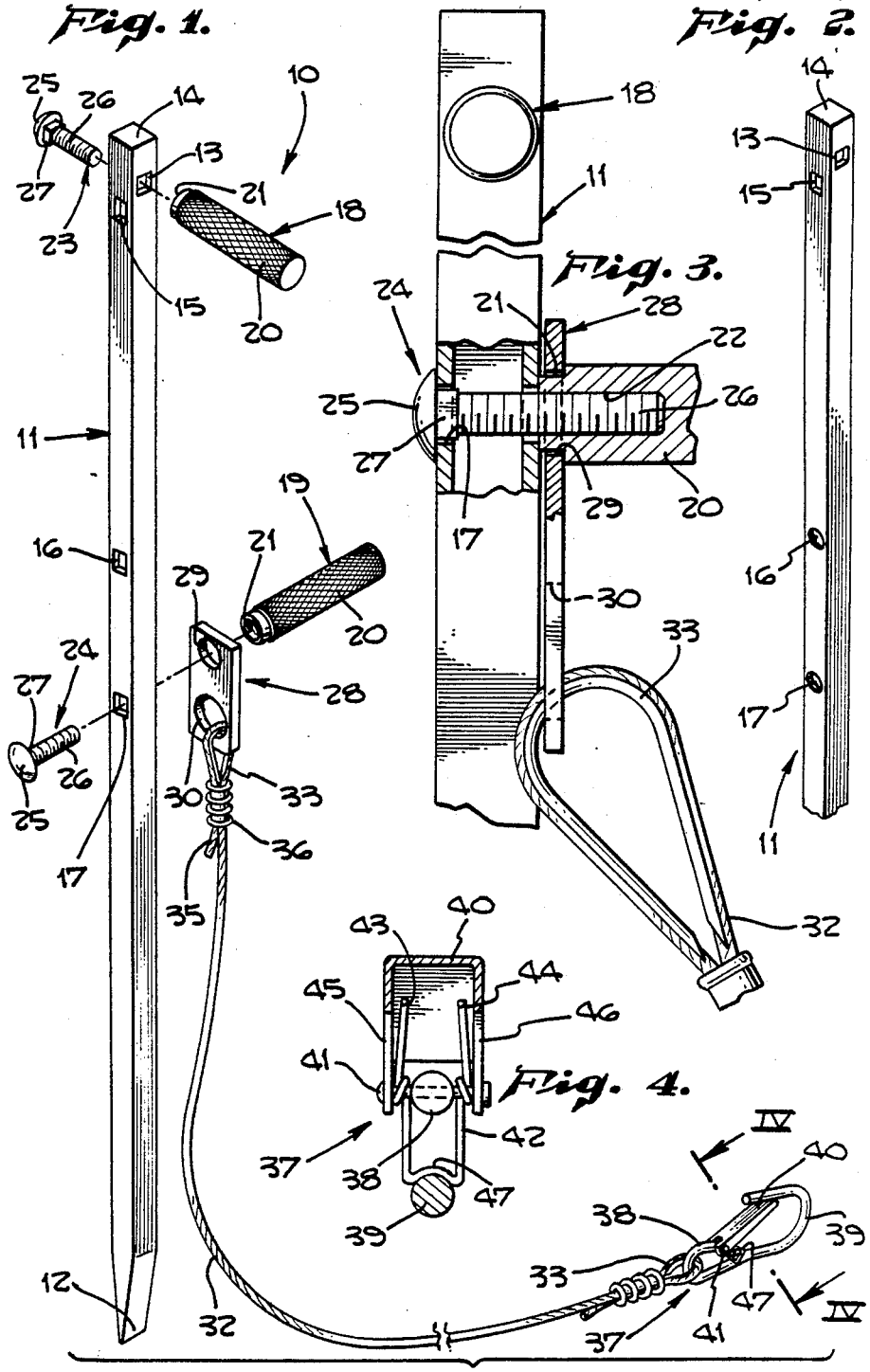
FIG. 1 is an exploded view of a boat stake in accordance with the teachings of the invention.
FIG. 2 is a rear perspective view of the stake portion alone of the boat stake of FIG. 1.
FIG. 3 is an assembled view of a portion of the boat stake of FIG. 1, the terminal hook being omitted for convenience of illustration.
FIG. 4 is a view taken along lines IV—IV of FIG. 1.

Referring now to FIG. 1 of the invention, a boat stake 10 in accordance with the teachings of the invention is shown. Boat Stake 10 includes a main elongated stake portion 11 terminating at a lower pointed end 12. As seen, stake portion 11 may be square in cross-section (or any other suitable cross-section) and has a plurality of holes therethrough. For example, at the upper end a first throughhole 13 (see also FIG. 2) is provided spaced slightly below the upper end 14 of stake portion 11 and having square shaped openings for reasons to be discussed. The interior of stake portion 11 may be solid; however, it may also be hollow to save on cost of manufacture. A second throughhole 15 (see also FIG. 2) is provided on stake portion 11 below hole 13 and spaced therefrom and also having a square-shaped opening thereto.

At approximately the midpoint of stake portion 11, a plurality, such as two, of spaced through holes 16, 17 are provided (see also FIG. 2). As seen in FIG. 1, on one side of stake portion 11, the openings leading into the holes 16, 17 are square-shaped and, as seen in FIG. 2, the openings leading into holes 16, 17 on the other side of stake portion 11 are round, for reasons to be discussed.

A pair of elongated members 18, 19, FIG. 1, which may be identical in construction, are provided, each member 18, 19 having a generally cylindrical main body portion 20 terminating in an integral cylindrical portion 21 of lesser outer diameter than portion 20. The exterior surface of portion 20 may be roughened or knurled as shown whereas the exterior surface of portion 21 may be smooth. As seen in FIG. 3, a threaded throughbore 22 may be provided through portion 21 and at least a portion of main body portion 20.

A pair of carriage bolts 23, 24 are provided and each may be identical in construction. Each bolt 23, 24 thus may have a slotless head 25, a threaded shank 26 adapted to mate with threaded throughbore 22, and an integral square-shaped nut portion 27 interconnecting head 25 and shank 26. As will be discussed, nut portion 27 is configured similar to holes 13, 15 to enter the same and be held therein in a non-rotating manner. It can be appreciated that any suitable non-round mating configuration can be used and, as will be discussed, bolt 23 can be inserted into any side of throughholes 13, 15.

A generally rectangular plate 28 (FIG. is provided having a pair of spaced throughholes 29, 30. As seen, the upper throughhole 29 is smaller in cross-section than the lower throughhole 30 and, also, slightly greater than the outer diameter of cylindrical portion 21 of the members 18, 19 (again, for reasons to be discussed further hereinbelow). Also, as seen in FIG. 3, the thickness of plate 28 is slightly less than the distance between shoulder 31 (at the intersection of portions 20, 21) so that the plate 28 will pivot freely as will be discussed.

An elongated flexible member, such as a rope 32 (FIG. 1) is provided for securing stake 10 to a boat (not shown). One end of rope 32 can be merely tied to opening 30: however, preferably, rope 32 terminates in an eye loop 33 (FIG. 3) having a U-shaped sheave 34 with the rope 32 extending about sheave 34 and having an end 35 (FIG. 1) extending into a collar 36. In this manner, eye loop 33 is formed. However, as will be appreciated, the free end 35 of rope 32 is first inserted through opening 30, about sheave 34 and through collar 36 where it is retained therein.

The other end of rope 32 terminates in a similar eye loop 33 so further discussion is deemed unnecessary. Again, the other end of rope 32 may not have such eye loop and may be merely tied to the releasable hook 37 (FIG. 1). Hook 37 has a U-shaped curved end 38 with an integral larger U-shaped curved hook portion 39. A lever 40 is pivotally connected to the free end of a curved end 38 via pivot pin 41 (FIG. 4) with a spring 42 having free ends 43, 44 encircling pin 41 between the side flanges 45, 46, respectively, of lever 40 and end 38. Free ends 43, 44 extend upwardly to normally bear against the underside of lever 40 as seen in FIG. 4. Spring 42 also has a bail portion 47 which bears against hook portion 39 as shown. Moving lever 40 upwardly against the bias of spring 42 allows the hook portion 39 to be inserted through a suitable connector, such as a bow eye on a boat, to thereby releasably secure rope 32 to the boat until lever 40 is again released. Of course, the eye loop 33 connected to hook 37 is merely placed about U-shaped portion 38 prior to assembly of lever 40, spring 42 and pin 41.

In assembling stake 10, plate 28 already attached to its eye loop 33 and hook 37 already attached to its eye loop one of the holes 16, 17 is selected depending on the depth to which it is desired to sink stake portion 11 (obviously depending on the type of ground, sand, weight of boat, tides, etc.). Also, a plurality of such spaced holes 16, 17 may be provided to allow a variety of preselected depths.

In any event, bolt 24 is inserted into the selected opening, such as upper opening 16 in FIG. 3, the nut portion 27 thereof entering the square-shaped hole opening as seen in FIG. 1 and being retained therein in a non-rotating manner. The cylindrical portion 21 of member 19 is now inserted into opening 29 of plate 28 and the shank 26 of bolt 24 is threaded into throughbore 22 of member 19 until secured to take portion 11 as seen in FIG. 3. Thus, plate 28 can freely move or pivot between shoulder 31 and stake portion 11 about cylindrical portion 21 to allow for movement thereon.

The upper member 18 is now secured in one of the holes 13, 15. The hole 13 or 15 is selected to provide for right or left hand use. Thus, bolt 23 is inserted through lower hole 15 (FIG. 3), the nut portion 27 thereof entering the opening into hole 15 and retained therein in a non-rotating manner. The stake 26 of bolt 23 is threaded into throughbore 22 of member 18 until cylindrical portion 21 abuts against stake portion 11 thereby firmly securing the same. Member 18 can be secured to hole 13 in like manner (as seen in exploded view in FIG. 1), depending on the desires of the operator.

The hook 37 is now releasably coupled to the bow (preferably) of a boat and stake 10 is used to pull the boat to a desired mooring location. The operator grasps handle member 18 and puts his or her foot on member 19 and pushes down so that end 12 penetrates the ground and continues such penetration until member 19 abuts against the ground. Plate 28 extends toward the boat and the boat is firmly moored until it is desired to release the same. At that time, handle member 18 is grasped and stake portion 11 is pulled out of the ground, member 19 also being available for grasping to assist in the same.

Any suitable materials may be used, such as metallic or plastic materials. Any suitable dimensions may be used. For example, stake portion 11 may be about 34" long, the cylindrical portions 20 may be about 3 ¾" long with portions 21 being about ¼" long (the portions 20 of members 18, 19 being about ¾" in outer diameter with portions 21 being about ⅝" in outer diameter). Carriage bolts 23, 24 may be about 1 ⅞" long and plate 28 may be about " by 1 ¼" with a thickness slightly less than ¼" Hole 29 is of course slightly greater in diameter than ⅝".

It can be seen that there is disclosed an economical and easily assembled boat stake which may be knocked down and stored until use, then quickly and easily assembled to moor a boat to a desired mooring location, such as offshore. The boat stake can be quickly and easily adapted to right or left hand use and used to moor a boat to a plurality of preselected depths.

Although there is disclosed a particular embodiment of the invention, variations thereof may occur to an artisan and the invention should be limited only by the scope of the appended claims.

I claim:

1. A boat stake for mooring a boat in a desired location comprising:

an elongated stake portion having a point at one end and a plurality of vertically spaced throughholes at the other end, the openings into said throughholes being irregular in cross-section;

a plurality of vertically spaced throughholes through said stake portion between said one end and said other end, each of said last-mentioned throughholes having a round opening in one side of said stake portion and terminating in an irregularly shaped cross-section on the other side of said stake portion;

a first elongated member having a threaded throughbore;

a first bolt having an enlarged head and a threaded shank of a diameter less than the diameter of said first mentioned throughholes and receivable therein, said shank being threadably receivable in the throughbore of said elongated member, said first bolt also having an irregularly shaped portion between said head and said shank configured to said irregular cross-section of said first mentioned throughholes to prevent rotation between said stake portion and said first elongated member;

a second elongated member having a threaded throughbore therein having a cylindrical portion at one end receivable in the round opening in a selected one of said second mentioned throughholes;

a second bolt having an enlarged head and a threaded shank of a diameter less than the diameter of said second mentioned throughholes and receivable therein, said shank being threadably receivable in the throughbore of said second elongated member, said second bolt also having an irregularly shaped portion between said head on said shank portion configured to said irregularly shaped cross-section of said second mentioned throughholes to prevent rotation between said stake portion and said second elongated member; and a generally rectangular plate having a first opening therein of a diameter less than the diameter of said cylindrical portion of said second elongated member receiving said cylindrical portion therethrough and disposed between said stake portion and the remainder of said second elongated member.

2. In the boat stake of claim 1 wherein said members are knurled on the outer surface thereof.

3. In the boat stake of claim 1 wherein aid second elongated member includes a first cylindrical portion and a second cylindrical portion extending through the opening in said plate, said first cylindrical portion being greater in outer diameter than the outer diameter of said second cylindrical portion, said plate being of a lesser thickness than the distance between said stake portion and the intersection of said first and second cylindrical portions of said second elongated member.

4. In the boat stake of claim 1 wherein said irregular cross-section of said first and second mentioned throughholes and the irregularly shaped portions of said bolts are square shaped.

5. In the boat stake of claim 1 wherein the enlarged heads of said bolts are slotless.

6. In the boat stake of claim 1 including a second opening in said plate receiving an elongated flexible member therein and secured thereto.

7. In the boat stake of claim 1 wherein the other end of said flexible member terminates in a releasable hook.

* * * * *